US005788228A

United States Patent [19]

Moll

[11] Patent Number: 5,788,228

[45] Date of Patent: Aug. 4, 1998

[54] ELECTRONICALLY ACTUATED TURNING DEVICE FOR TRANSPORT APPARATUS

[76] Inventor: Richard J. Moll, 415 Constance Dr., Warminster, Pa. 18974

[21] Appl. No.: 752,241

[22] Filed: Nov. 19, 1996

[51] Int. Cl.[6] ..... B65H 5/00

[52] U.S. Cl. ..... 271/225; 271/184; 271/185; 271/250; 271/253; 271/227; 271/229; 198/416

[58] Field of Search ..... 271/225, 227, 271/248, 250, 253, 184, 185; 498/416, 374

[56] References Cited

U.S. PATENT DOCUMENTS 5,342,040 8/1994 Markgraf ..... 271/184
5,390,909 2/1995 Herricks ..... 271/248
5,568,920 10/1996 Moll ..... 271/225

FOREIGN PATENT DOCUMENTS 405301659 11/1993 Japan ..... 271/225

*Primary Examiner*—H. Grant Skaggs
*Attorney, Agent, or Firm*—Zachary T. Wobensmith, III

[57] ABSTRACT

An electronically actuated turning device for transport apparatus which receives product such as paper folders, detects the presence of the product, causes a ball to contact the product and allows the product to rotate 90 degrees, releases the ball and allows the product to be transported in the same direction by the apparatus for further operations as required.

5 Claims, 3 Drawing Sheets

11
10
12
14
15
17
18
19
20
21
24
25
26
27
28
29
30
31
32
33
34
35
36
37
38
40
41
46
61
62
63
64
65
68
70

ELECTRONICALLY ACTUATED TURNING DEVICE FOR TRANSPORT APPARATUS

BACKGROUND OF THE INVENTION

1. Field of the Invention

This invention relates to an electronically actuated turning device for use with transport apparatus of the type that optically detects the presence of a sheet of paper, provides a control signal to cause a solenoid to be activated to cause a turning device to contact a product to cause it to change its orientation by 90 degrees during its travel.

2. Description of the Prior Art

When processing products such as folded paper jackets, it is often desirable to change the orientation of the product by 90 degrees, for further operations on the product in the same or other equipment, such as applying pocket folds or stacking. This orientation change, for example, with endless belt transport of paper folders, is usually accomplished by depositing the product on intersecting belts that are perpendicular to the direction of travel of the original transport apparatus. This method requires additional transport apparatus with a bed, frame, endless belts, driving motor and controls which is expensive, and requires more space, and coordination between the intersecting transport apparatus, and is generally not satisfactory.

In my prior application Ser. No. 08/588,268 filed Jan. 18, 1996 and now U.S. Pat. No. 5,568,920, a turning device was disclosed that included a bump ball to engage the products, which ball was carried in a housing attached to a shaft which was connected to a tube from a support bar. While this device is satisfactory, the contact portion of the device remains at a fixed distance from the bed plate on which the products were transported. It is desirable to have a turning device that is retracted until a product comes along, is detected, and the contact portion of the device travels downwardly until it contacts the product, and after the product turns moves upwardly out of the way. The turning device of the invention is adaptable to virtually all types of belt transport apparatus and provides many positive advantages over the prior art.

SUMMARY OF THE INVENTION

It has now been found that a device is available that is attached to a transport apparatus, optically observes approaching product, signals a solenoid to move the turning device downwardly to contact product, stops the product and in conjunction with the transport portion of the apparatus causes the product to change its orientation by 90 degrees. The device is retracted upwardly out of the way, and the product continues to travel in the same direction.

The principal object of the invention is to provide an electronically actuated turning device for transport apparatus that stops the product, and causes the orientation of the product to change by 90 degrees and is retracted.

A further object of the invention is to provide a turning device of the character aforesaid that is useful with a variety of transport apparatus.

A further object of the invention is to provide a turning device of the character aforesaid that accommodates different types and thicknesses of product.

A further object of the invention is to provide a turning device of the character aforesaid that is easy to install and to remove.

A further object of the invention is to provide a turning device that is inexpensive to construct, but is durable and long-lasting in operation.

A further object of the invention is to provide a turning device that is fast and positive in operation.

Other objects and advantageous features of the invention will be apparent from the description and the claims.

DESCRIPTION OF THE DRAWINGS

The nature and characteristic features of the invention will be more readily understood from the following description taken in connection with the accompanying drawings forming part hereof in which.

It should of course be understood that the description and drawings herein are merely illustrative, and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
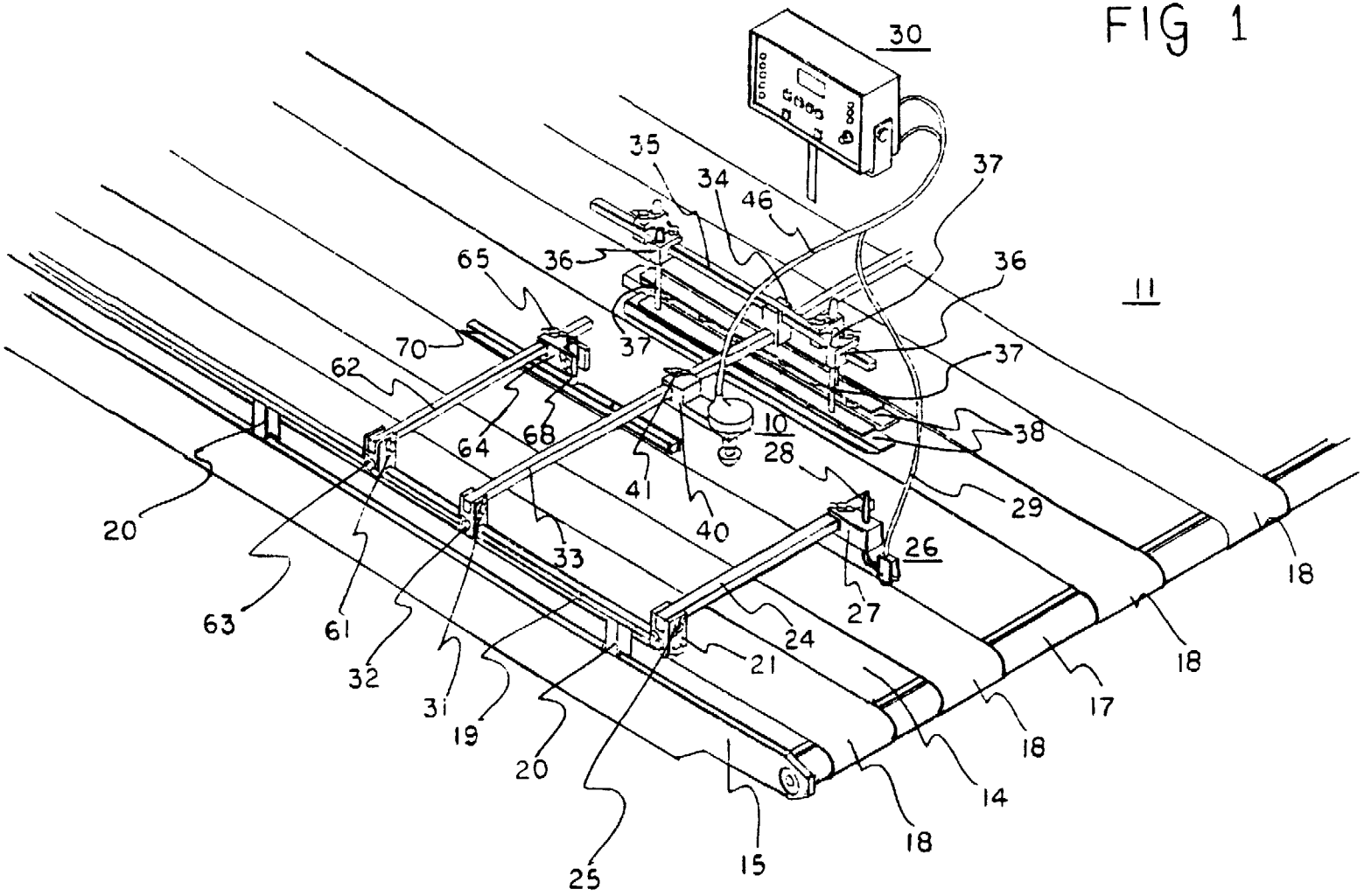
FIG. 1 is a perspective view of the turning device of the invention installed on a transport apparatus.
Figure 2:
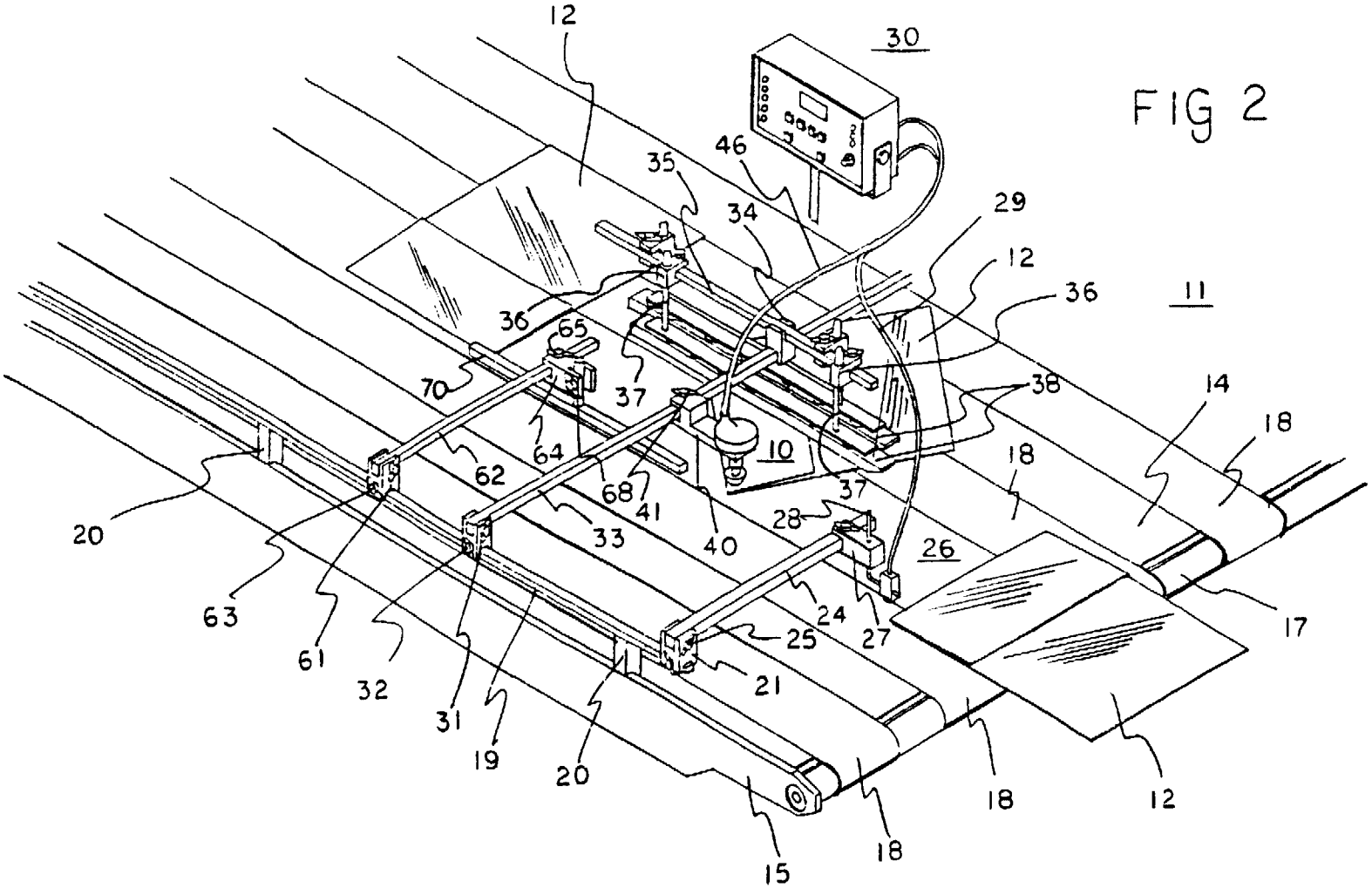
FIG. 2 is a view similar to FIG. 1 showing the device in operation.

Referring now more particularly to FIGS. 1 and 2 of the drawings, one embodiment of the turning device 10 is therein illustrated in operation on a transport apparatus 11. The transport apparatus 11 is typical of such apparatus which transport or convey various products such as folded paper jackets 12. The apparatus 11 includes a frame (not shown), having a top pan or bed 14, and at least one side rail 15. The top pan 14 is smooth and preferably of metal, with a rotatable roller 17 extending from the rail 15 across the front of the apparatus.

A plurality of endless driven belts 18 are provided, of well known type, engaged with roller 17 and extending along pan 14 for transporting or conveying jackets 12. The side rail 15 has a track bar 19 connected by blocks 20 thereto, and which extends therealong. A bracket 21 is provided detachably secured to track bar 19, and with one end of a support bar 24 secured thereto by thumbscrew 25, and which extends transversely across the pan 14. The support bar 24 has an electric eye 26 of well known type mounted thereto by an adjustable bracket 27, and a rod 28 carried in bracket 27 to provide for vertical and horizontal positioning of eye 26. The electric eye 26 is connected by wire 29 to a control apparatus 30 such as the Glu Bind Quadra Plex control apparatus, available from Dick Moll & Sons, Inc., Warminster, Pa. The apparatus 30 causes energization of the electric eye 26, and receives a signal therefrom when an approaching object, such as a folder 12 is perceived.

The track bar 19 has a bracket 31 detachably secured thereto by thumbscrew 32, and movable therealong, with a support bar 33 engaged therewith, which extends across pan 14 and is attached to a trackbar (not shown) of apparatus 11 at the other side.

The support bar 33 has a bracket 34 engaged therewith carrying a rod 35, which has brackets 36 attached thereto, and to rods 37 which extend to and are engaged with marble guide plates 38 of well known type, which have marbles (not shown) which engage the folders 12 and restrain them from vertical movement, pull the folders around in a 90 degree arc and provide passage underneath the plates 38. The support bar 33 has a mounting clamp 40 engaged therewith by a thumbscrew 41, for restraint at selected locations on bar 33.

The clamp 40 has the turning device 10 secured thereto, with a wire 46 connecting the device to the control apparatus 30.

Figure 4:
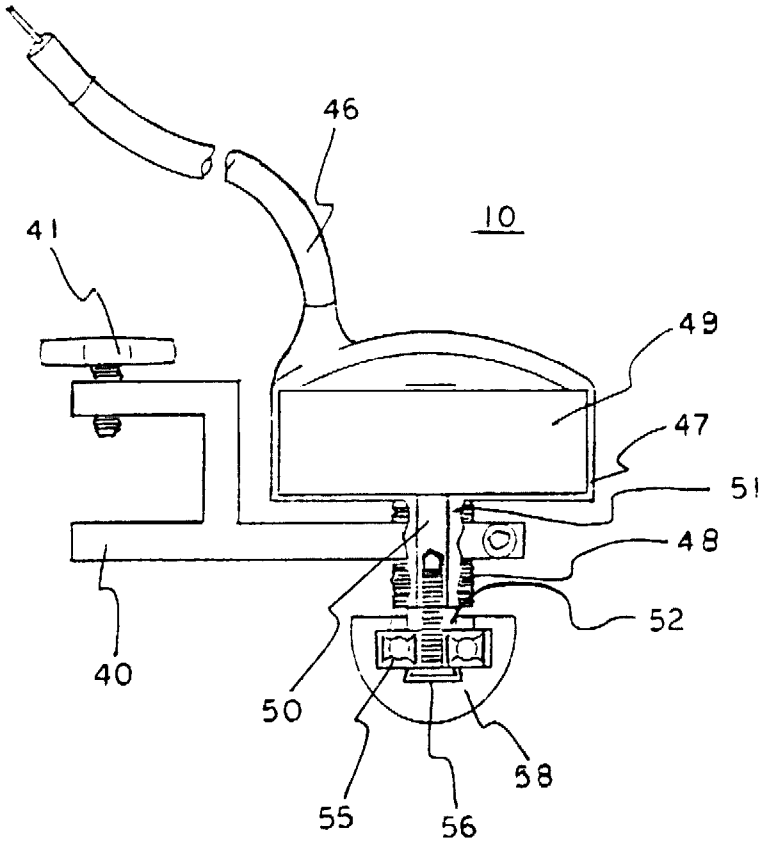
FIG. 4 is view similar to FIG. 3, in partial section, to show the inner construction of the device.
Figure 3:
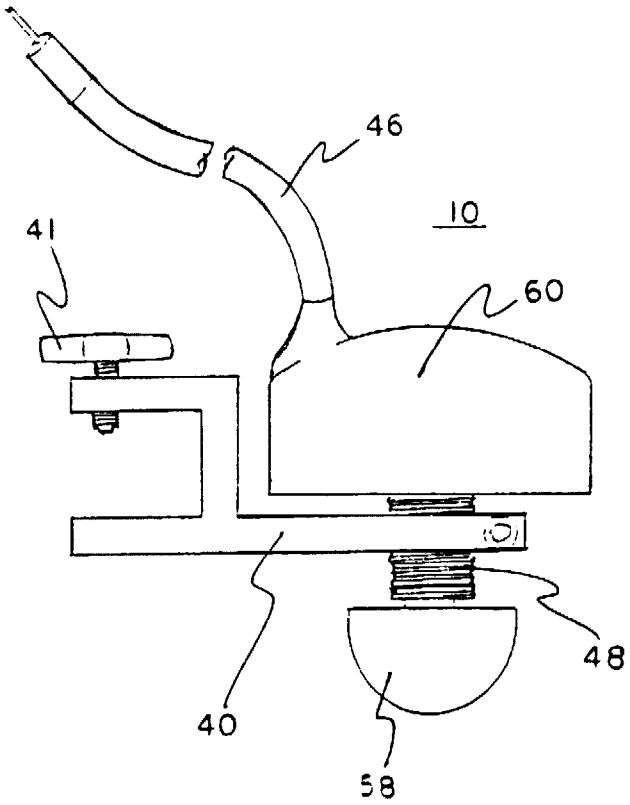
FIG. 3 is a side elevational view of the turning device of the invention.

The turning device 10 is illustrated in detail in FIGS. 3 and 4 and includes an outer housing 47 with a hollow threaded tube 48 extending therefrom and engaged with the clamp 40 for vertical adjustment.

The housing 47 has an electronic solenoid coil 49 mounted therein, with an activation rod 50 extending downwardly through passageway 51 in tube 48, and integral with a hub 52 carried in the passageway 51.

The hub 52 has a ball bearing 55 mounted thereto by a screw 56 in well known manner.

The ball bearing 55 is captured by a molded swivel ball 58, preferably of synthetic rubber of a hardness of 60 durometer, which is adapted to fit around the ball bearing and can be snapped on and off for replacement. The ball bearing 55 permits the ball 58 to rotate about the hub 52.

The housing 47 has a removable solenoid cover 60 engaged therewith to protect the coil 49.

The trackbar 19 has a bracket 61 engaged therewith, and with a bar 62 which extends across the pan 14 and is restrained thereto by thumbscrew 63.

An additional bracket 64 is engaged with bar 62, with a thumbscrew 65 therein for adjustment, with a rod 68 engaged therewith, and with a guide bar 70 which extends in the direction of travel of the belts 18. The guide bar 70 guides folders 12 after rotation to be described.

The mode of operation will now be pointed out.

The control apparatus 30 is adjusted for proper operation of the turning device by first determining the delay time, i.e. travel time, which is based on the distance from the electric eye 26 to the center of the ball 58 of turning device 10, plus the distance on the folder 12 from its leading edge to where the ball 58 contacts the folder 12. This delay time is set on control apparatus 30. The solenoid activation time must be determined, which is the length of time that the solenoid coil 49 is energized to cause the ball 58 to touch the folder 12, and hold the folder until it pivots or swings in a 90 degree arc, and contacts the guide bar 70. The solenoid activation time is set in control apparatus 30. Jackets 12 are fed onto belts 18 from other sources to be conveyed on transport apparatus 11. The turning device 10 is adjusted above pan 14 to locate the ball 58 at height to accommodate the thickness of the stock to be turned. The jackets 12, one at a time, are detected by the electric eye 26 which signals the control apparatus 30 and the delay time starts running. When the jacket 12 comes under the ball 58, the delay time has expired, the apparatus 30 activates solenoid coil 49 which through rod 50 moves ball 58 down into contact with a predetermined spot on the jacket 12.

The solenoid 49 continues to hold the jacket 12 and belts 18 carry it into contact with the marble guide plate 38 where it is gripped between the marbles (not shown) and the belts 118. The ball bearing 55 permits the jacket 12 to pivot until the solenoid activation time expires, which is when the jacket has swung around 90 degrees and contacted guide bar 70. The solenoid 49 is deenergized, the ball 58 is released from contact with the jacket 12 and the jacket is carried forward on belts 18 on the apparatus 11 for processing.

The next jacket 12 in line is detected and the operation continues until all the jackets 12 have been transported.

It will thus be seen that an electronically actuated turning device for transport apparatus has been provided with which the objects of the invention are attained.

I claim:

1. An electronically actuated turning device for stopping, and then turning products being conveyed on endless belts on a flatbed transport apparatus at at least a 90 degree angle from their original orientation, and which are then again transported in their original direction, which comprises a track bar attached to at least one side of said bed, a first support bar means attached to said track bar which extends transversely across said bed, first bracket means attached to said support bar means and positionable at selected locations thereacross;

electronic eye means attached to said first bracket means to detect the presence of a product, control means connected to said electric eye means for energization and signal reception from said electric eye means, a second support bar means attached to said track bar and which extends transversely across said bed, second bracket means attached to said support bar means and positionable at selected locations thereacross;

marble guide bar means attached to said second bracket means and positionable to engage said products which pass between it and said bed;

mounting clamp means attached to said second support bar means and positionable thereacross;

turning device means engaged with said mounting clamp means, said turning device means includes an outer housing, a hollow tube engaged with said housing and said clamp means, an electronically actuated solenoid coil in said housing, connection means to connect said coil to said control means, an activation rod extending from said coil through said tube, a ball bearing carried on said rod, a swivel ball engaged with said bushing, and rotatable therewith for product contact and rotation, a guide support bar means mounted to said track bar and extending transversely across said bed, a means engaged with said guide support bar bracket, a second rod engaged with said guide support bar means, and a guide bar engaged with said second rod and which is oriented in the direction of conveyance of said product to receive and guide said product after it is rotated by said swivel ball.

2. A turning device as defined in claim 1 in which;

said swivel ball is round and formed of synthetic rubber.

3. An electronically actuated device as defined in claim 1 in which:

said marble guide bar means includes means for vertical and horizontal positioning thereof.

4. An electronically actuated turning device as defined in claim 1 in which;

said swivel ball is molded and fitted around said ball bearing.

5. An electronically actuated turning device as defined in claim 1 in which:

said hollow tube is threadably engaged with said clamp means for vertical swivel ball height adjustment.

* * * * *

UNITED STATES PATENT AND TRADEMARK OFFICE

CERTIFICATE OF CORRECTION

PATENT NO. : 5,788,228

DATED : August 4, 1998

INVENTOR(S) : Richard J. Moll

It is certified that error appears in the above-indentified patent and that said Letters Patent is hereby corrected as shown below:

Column 4

Line 4 "118" should be -18-.

Signed and Sealed this

Seventeenth Day of November, 1998

*Attest:*

*Attesting Officer*

BRUCE LEHMAN

*Commissioner of Patents and Trademarks*